US005096229A

United States Patent [19]

Carlson

[11] Patent Number: 5,096,229

[45] Date of Patent: Mar. 17, 1992

[54] METHOD FOR PRODUCING IDENTIFICATION CARDS

[76] Inventor: Thomas S. Carlson, 19 Mid Oaks Rd., St. Paul, Minn. 55113-5612

[21] Appl. No.: 585,614

[22] Filed: Sep. 20, 1990

[51] Int. Cl.[5] ..... B42D 15/00

[52] U.S. Cl. ..... 283/75; 283/67; 283/107

[58] Field of Search ..... 283/75, 74, 67, 70, 283/85, 86, 107-109, 110

[56] References Cited

U.S. PATENT DOCUMENTS

| | | | |
|---|---|---|---|
| 3,273,785 | 9/1966 | Beckman . | |
| 3,319,872 | 5/1967 | Beckman . | |
| 4,447,481 | 5/1984 | Holmberg et al. . | |
| 4,525,116 | 6/1985 | Holmberg . | |
| 4,579,754 | 4/1986 | Maurer et al. | 283/75 X |
| 4,590,109 | 5/1986 | Holmberg . | |
| 4,618,520 | 10/1986 | Holmberg . | |
| 4,732,410 | 3/1988 | Holbein et al. | 283/75 X |
| 4,951,864 | 8/1990 | Dicker . | |

OTHER PUBLICATIONS

"8 out of 10 Businesses Can't Be Wrong", FORM May 1989, p. 90.

Avery Label Company (Reference 2), instructions for fold over film.

Reference 3-samples of base paper sheet with imprintable film adhered (Avery Label Company, Hunkeler Corporation and Gluefold).

Reference 4-Unique Embossing Services-copy of laser printable plastic die cut to form identification cards.

Reference 5-"tipped on ID cards"-copy of literature from Hunkeler Corp., Infoseal System, Champion Business Forms, Vanier Graphics & Gluefold.

Reference 6-Composite Technologies, Inc. copy of literature regarding paper sheet stock to which plastic is adhered.

*Primary Examiner*—Timothy V. Eley
*Assistant Examiner*—William Fridie
*Attorney, Agent, or Firm*—Vidas & Arrett

[57] ABSTRACT

A sheetstock for preparing mailers including die-cut identification cards which may be printed with a laser printer. The sheetstock includes a laser printable plastic laminated to a portion of the sheetstock. That portion is die-cut to define one or more identification cards. The remainder of the sheetstock includes a second layer of paper adhered thereto which allows the sheetstock to feed through a laser printer feed tray.

5 Claims, 2 Drawing Sheets 30
34
16
32
18
28
12
10
26

30
22
16
20
26
20
22
12

METHOD FOR PRODUCING IDENTIFICATION CARDS

BACKGROUND OF THE INVENTION

1. Field of the Invention

This invention relates to identification cards, and more particularly to methods for forming plastic cards printable in a laser printing process.

2. Description of the Related Art

Previous methods for making identification cards include embossed plastic cards and plain paper cards. Embossed cards are relatively expensive to make. Plain paper cards are inexpensive, however, they are not long lasting and do not convey a polished image.

Plastic cards have been produced in which an impact printer is used to mark a sheet of die-cut plastic or plastic-coated paper and some plastics. Such printers have relatively poor quality and are unable to form quality bar codes on such cards on the same sheet.

Laser printers are able to form high quality text and graphics on paper and some plastics. However, due to their construction, laser printers are finicky and are unable to handle varying thicknesses of paper on the same sheet.

Many companies wish to send identification cards to customers along with a cover letter. Previous attempts to use laser printers have failed to produce acceptable pages bearing plastic die-cut identification cards.

SUMMARY OF THE INVENTION

The invention has developed a method in which industrial high speed laser printers can rapidly produce identification cards in a letter format. A plain sheet of paper is utilized as the "core" to which laser printable plastic may be applied to the front and optionally the back over a portion of the sheet sufficient to form the number of cards desired.

The cards are formed by conventional die cuts which allow a user to remove the cards from the sheet when desired. The remainder of the sheet must be substantially covered with a second layer of paper or other sheet stock to increase the thickness of the sheet to that approximating the thickness of the plastic-coated portion. If plastic is applied to both sides, a space of at least about 1/16" must be left between the plastic coated portion and the second paper layer coated portion.

It has been found that a sheet of paper bearing a plastic coated section with the die-cut cards will not properly feed in many laser printers. The paper feeding, paper transport, fusing systems, imaging systems and timing registration devices in many laser printers are extremely sensitive to variations in thickness and weight distribution. When a sheet of paper having a plastic-coated section is to be fed into a laser printer, the paper feeding and imaging process falls out of alignment, causing many of the images on the sheets to be misaligned and poorly imaged by the laser printer. In addition, the paper may jam in the machine. The inventor's solution to this vexing problem places a second layer of paper over most or all of the paper which is not covered by plastic. This second layer makes a stack of such sheets feed smoothly into and through laser printers without jams, misalignments or poor imaging. The second layer also makes the paper more level and even when stacked in the laser printer's infeed hopper and in shipping and storage. The space left between the plastic and second layer ensures this uniform feeding to the printer even when a plastic coating is placed on the bottom as well as the top of a portion of the sheets.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
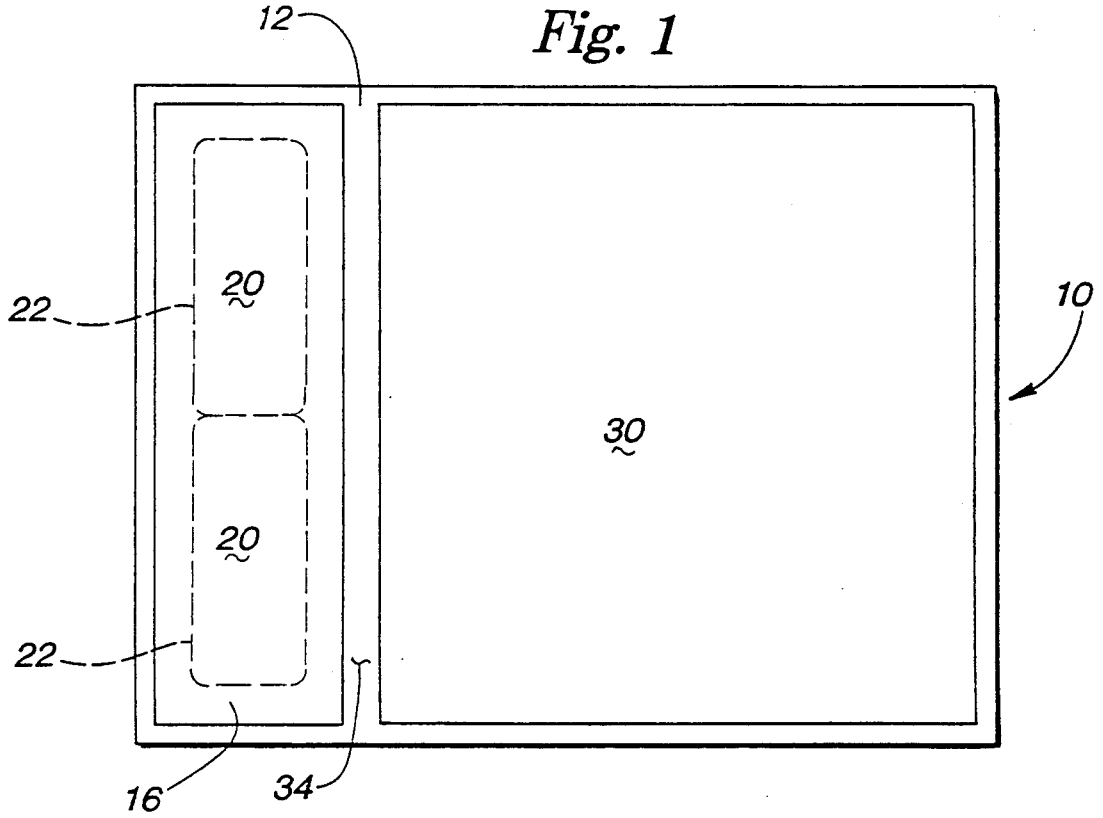
FIG. 1 is a top view of a page of sheet stock bearing text and die-cut identification cards.
Figure 3:
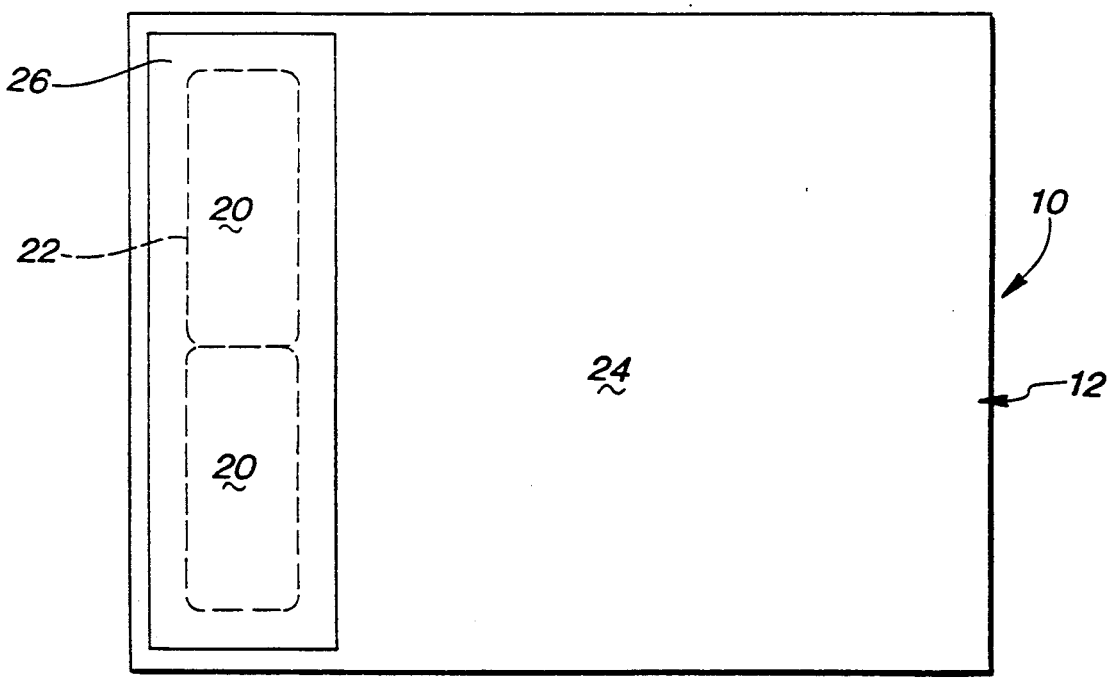
FIG. 3 is a bottom view of the sheetstock of FIG. 1.
Figure 2:
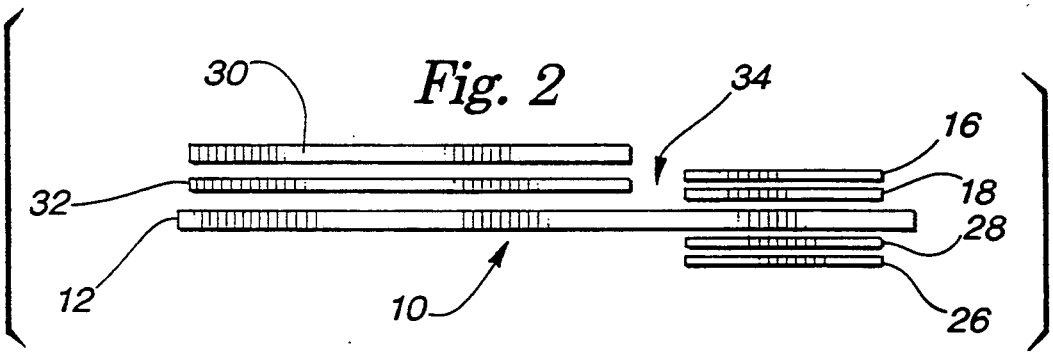
FIG. 2 is a cross-sectional view of the page of FIG. 1.
Figure 4:
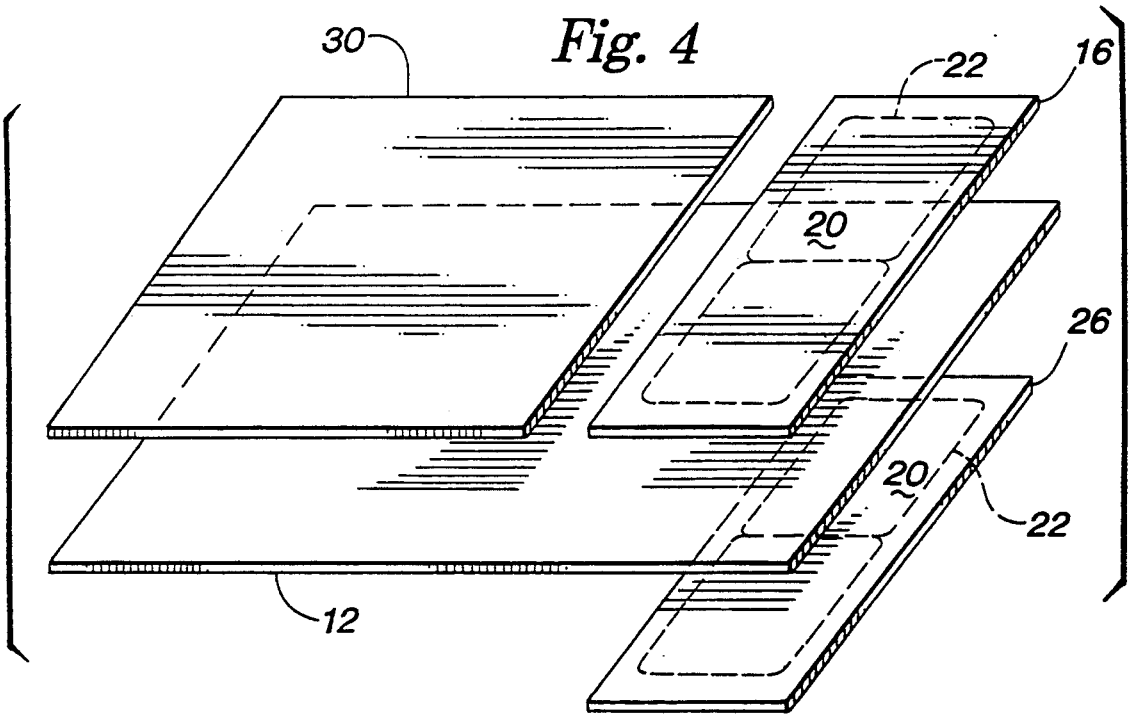
FIG. 4 is an exploded view of the sheetstock of FIG. 1 showing the plastic and paper layers without adhesive being shown.

With reference to the Figures it will be seen that sheetstock 10 is formed from a page of paper 12 to which a top layer of plastic 16 is laminated or otherwise adhered by adhesive 18. Plastic layer 16 is fabricated from any of the plastics which are currently in use in laser printing. Such plastics must facilitate and accept the transfer and adhesion of laser imaging toners. Since such applications involve substantial heat, these plastics are quite heat resistant.

Identification cards 20 are formed in the plastic/paper laminate by die cutting the sheetstock. Such die cuts 22 are well known and include a combination of ties and slits that allow the card 20 to remain together through identification card production and laser printing until the recipient pops it out of the sheet. The slits completely penetrate all layers of the laminate. To keep the card in place and from popping out in the laser printer, ties should be left at all corners.

The cards to be formed are preferably plastic on both sides to provide a better looking and longer lasting ID card. The back 24 of sheetstock 10 may include a bottom layer of plastic 26 laminated or adhered by adhesive 28 to paper 12 as with the front layer 16. The bottom layer need not be laser printable if the information is already printed on that sheet (as in the case of unchanging information about the supplier).

It has been found that a sheet constructed as described above will not work satisfactorily in a laser printer. The papers may not be fed into or be transported through the laser printers properly. The paper may also be slightly out of alignment which causes the cards created to be imperfect at the least and possibly unusable. The sheetstock must include a second layer of paper 30 adhered with adhesive 32 to page 12 as shown in the Figures. This second sheet of paper is applied over substantially the entire surface of page 12 which is not covered with plastic 16. This top paper layer 30 readily accepts any laser printing and causes the sheetstock to feed evenly into and through the laser printer.

If a second layer of plastic 26 is present on back 24, a gap or space 34 must be maintained between top paper 30 and plastic 16. This gap makes the sheetstock slightly more flexible at that point and functions as a hinge to keep the paper flatter as it travels through the laser printer's infeed device, paper transport, output systems, imaging and fusing systems. This allows the paper to flex slightly and to compensate for the fact that the plastic 26 on the back 24 makes the sheet uneven. However, the thickness of the top paper 30 is selected such that the thickness through the sheetstock at the second paper 30 is approximately equal to the combined thickness of the page 12 and plastics 16 and 26 together with little adhesives. When so constructed, the sheetstock will feed evenly and print properly in a laser printer. The gap or space 34 must be at least about one-sixteenth of an inch (1/16") and preferably at least about absent ⅛" to ¼" to allow this flexibility. As the layers are made thinner a smaller gap is needed. The second sheet of paper 30 basically compensates for the presence of the plastic layer on an end of the sheet by equalizing the thickness and re-balancing the sheetstock. The internal synchronization systems of the laser printers work well when the paper sheet is added to balance the weight distribution and to equalize the thickness of the sheetstock. Generally, the more the surface of the page 12 is covered by second paper 30 the better, with the exception of the need for space 34.

PREPARATION OF SHEETSTOCK

Sheetstock 10 may be prepared in any procedure currently utilized for attaching layers of plastic or paper to a page, such as in advertising flyers. One method for forming the sheetstock would be to attach second paper layer 30 to paper pages 12 and roll that product onto a large roll to reduce curling the paper stock and subsequent memory curl in the plastic and paper. The paper can then be unwound to a station in which the plastic layer 16 is adhered. The paper may then be rewound onto a roll and unwound to apply the bottom plastic 26. The completed product may then be fed to a sheeter where the roll of material is cut to conventional lengths and the cut singles are stacked. It is also possible to form the sheetstock in a single step by applying the plastic layers lengthwise or cross-wise to the paper roll which allows plastic and paper to be adhered simultaneously. The paper would then be cut to convert it from a "landscape" orientation to a "portrait" orientation.

It has been found that the paper utilized is preferably a 24 pound white wove paper. Such paper typically has a thickness of about 0.05 inches which when adhered to the second paper layer area provides a sheetstock thickness of 0.10 inches. The plastic layers 16 and 26 are then typically about 0.025 inches each, which combined with the paper page 12 and adhesive gives a combined thickness of about 0.10 inches.

Preferably, the laser toner will use a magnetic ink character recognition type toner which fuses better to the plastics and is less susceptible to flaking from the plastic. The adhesives should be selected with the application in mind, that is, they must be able to withstand the high temperatures to be encountered in the laser printing process. Any of the commonly used adhesives for such applications involving plastic and paper adhesives may be used. If the adhesive employed allows the plastic to peel free from the paper a coating may be applied to the plastic which will improve the adhesion of the plastic to the adhesive and paper. Also, the plastics 16, 26 may be coated with a coating to improve the ability of the plastic layer to accept laser toner. Any such coatings may be utilized.

The sheetstocks 10 thus formed may include a perforation line in space 34 to allow the cards 20 to be separated from the upper portion of the sheetstock. The upper portion of the sheetstock bearing the second paper layer 30 may contain markings, perforations and information such that it can function as a return mailer.

Although the invention is needed most in sheet fed laser printers, it may also be utilized in continuous feed form and would include register holes to align with pins on the printer. In any case, the invention provides sheetstock which may carry a written message on the second paper layer 30, back 24 and quality laser printing on both sides of the identification cards 20. This high quality allows the placement of laser printed machine readable bar codes, optical character recognition (OCR) or magnetic ink character recognition (MICR) on the cards 20. Such information means that a holder of such a card may display it at a doctor's office where the bar code is scanned and read, greatly speeding up the process and requiring less personnel to make insurance claims.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. Sheetstock for preparing identification cards printed with a laser printing process; comprising:

(a) a sheet of paper having a top, bottom and an upper and lower surface;

(b) a first layer of laser-printable plastic adhered to a portion of the upper surface of said sheet, said sheet and plastic layer including a plurality of closely spaced perforations therethrough to define therewith at least one identification card which may be separated from the remainder of the sheetstock; and (c) said paper sheet further including a second layer of paper adhered thereto over substantially the remainder of said upper surface of said sheet not coated by said first plastic layer.

2. The sheetstock of claim 1 further including a second layer of plastic adhered to a portion of the lower surface of said paper sheet directly underneath said first plastic layer, said closely spaced perforations extending through al layers to allow removal of said cards so defined, said second layer of paper being spaced from said first layer of plastic by at least one-sixteenth of an inch.

3. The sheetstock of claim 1 wherein said plurality of closely spaced perforations through said layers define two or more removable identification cards, each of said defined identification cards sharing a common border with at least one other of said identification cards.

4. A method for forming laser printed plastic coated identification cards comprising the steps of:

(a) obtaining a supply of sheetstock each formed from a first sheet of paper to which a laser printable plastic has been adhered to a portion of the surface thereof and the remainder of said surface is substantially covered by a second paper layer which is adhered or otherwise bonded to said first sheet of paper, each of said sheets including a plurality of closely spaced perforations therethrough to define therewith at least one identification card which may be separated from the remainder of the sheetstock;

(b) aligning said supply of sheetstock in a paper feed tray of a laser printer;

(c) sending information to said laser printer to supply text and any graphics to the printer for application of toner to said sheetstock; and (d) running said printer such that sheetstock is laser printed to include information on each of said identification cards.

5. The method of claim 4 wherein bar codes are imprinted on said cards by said laser printer.

* * * * *